US006095338A

United States Patent [19]

Connolly et al.

[11] Patent Number: 6,095,338

[45] Date of Patent: Aug. 1, 2000

[54] SEPARATORY SCREEN

[75] Inventors: Michael S. Connolly, Princeton, W. Va.; Stephen R. Andretich, Plainfield, Ill.

[73] Assignee: Conn-Weld Industries, Inc., Princeton, W. Va.

[21] Appl. No.: 09/081,791

[22] Filed: May 20, 1998

[51] Int. Cl.[7] ..... B07B 1/06

[52] U.S. Cl. ..... 209/274

[58] Field of Search ..... 209/274, 281, 209/392, 393, 400

[56] References Cited

U.S. PATENT DOCUMENTS

| | | | |
|---|---|---|---|
| Re. 8,313 | 7/1878 | English | 209/393 |
| 2,872,041 | 2/1959 | Fontein et al. . | |
| 2,916,142 | 12/1959 | Fontein | 209/274 |
| 2,942,730 | 6/1960 | Fontein . | |
| 3,007,574 | 11/1961 | Koning | 209/281 |
| 4,113,626 | 9/1978 | Detcher . | |
| 4,193,503 | 3/1980 | Connolly | 209/393 |
| 4,250,038 | 2/1981 | Dryden . | |
| 4,274,952 | 6/1981 | Hanke et al. . | |
| 4,422,937 | 12/1983 | Connolly . | |
| 5,255,790 | 10/1993 | Einoder et al. . | |

*Primary Examiner*—Christopher P. Ellis
*Assistant Examiner*—Joe Dillon, Sr.
*Attorney, Agent, or Firm*—Jones, Tullar & Cooper, P.C.

[57] ABSTRACT

A sieve screen utilizes a frame to support a plurality of profiled screen wires. These screen wires are arranged on the frame in a symmetrical manner about a center line which is transverse or normal to the direction of flow of material to be separated. The sieve screen can be inverted and rotated to extend its life after the profile screen wires initially situated above the transverse central line have lost their separatory effectiveness.

8 Claims, 7 Drawing Sheets

SEPARATORY SCREEN

FIELD OF THE INVENTION

The present invention is directed generally to a separatory or screen. More particularly, the present invention is directed to a two way sieve screen having tilted profile screen wires. Most specifically, the present invention is directed to a profile screen wire sieve screen in which the profile screen wires are tilted symmetrically about a transverse screen center line. The symmetrical or two way tilt of the profile wires of the sieve screen provides a sieve screen which is particularly usable in sieve applications where the slurry to be separated or de-watered is fed onto the screen adjacent its upper end. During usage of the screen, sharp edges of the tilted profile screen wires situated in the upper portion of the sieve screen wear away. Once the efficiency of the screen has decreased below an acceptable level, because of the wearing away of the screen wires, the screen can be reversed by being rotated 180° about its transverse center line to present essentially new screen wires for use.

DESCRIPTION OF THE PRIOR ART

Static screens are generally known in the art for use in separating slurries of flowable materials into their separate components. In such static screens, the slurry is caused to flow down and across the surface of the screen, which is composed of a large number of generally triangular profile screen wires. As the slurry is caused to flow across the surface of the screen, the liquid flows through the spaces between the profile screen wires while the now dewatered particles travel along the surface of the screen. The profile screen wires are typically disposed parallel to each other, and are generally normal to the flow direction of the slurry as it passes over the surface of the screen.

In prior art screens, the efficiency of the screen has been attempted to be improved by varying the lateral spacing of the screen wires, by providing irregular upper surfaces of the screen wires and by angling the upper surfaces of the screen wires with respect to the direction of flow of the slurry to be separated. Various angles of inclination of the screen wires, with respect to the direction of flow, as well as various angles of declination of the screen wires, with respect to the direction of flow, have been attempted. With respect to using an angle of inclination, in which the leading edge of the upper surface of the generally triangular screen wire is raised upwardly with respect to the trailing edge, as taken in the direction of flow, the theory appears to be that this inclined leading edge will direct some of the water or other liquid to pass through the space between each screen wire and the adjacent upstream wire. With respect to using an angle of declination, in which the trailing edge of the upper surface of each screen wire is raised with respect to the leading edge of the upper surface of each profile wire, as viewed in the direction of flow, the theory may be that a turbulence is created which enhances the separating ability of the sieve screen.

In prior screens whether the angle of the individual screen wires has been one of inclination or declination with respect to the flow direction, this angle has been the same along the entire length of the screen. The thought has apparently been that the entire length of the screen performs some type of separatory function and that the angle of inclination or declination should be the same over the screen's entire length.

One application for curved sieve screens has been in the corn wet melting area. Another use is in paper mills. In corn wet milling, the corn kernel is ground or cracked and the ground corn is put into the slurry or suspension by mixing with water. This causes the corn starch to dissolve and to go into solution. In order to separate the corn starch solution from the solid particles, the slurry is fed to an upper or inflow end of a generally rectangular, arcuate pressure sieve which typically has a 30 inch radius with the screen extending over an arc of generally 120°. The slurry is fed to the screen at a pressure of 20–65 lb. pressure and the liquid corn starch is separated by passing through 50 micron (0.002 inch) to 250 micron (0.010 inch) openings between adjacent, parallel profile screen wires.

Conn-Weld Industries, Inc., the assignee of the subject patent application, produces a corn wet milling screen in which all of the profile screen wires have the same direction of tilt. This prior sieve screen does an effective job of separating the corn slurry into its components. As the screen is subjected to operation over 9–12 months, at a pressure of 20–65 lb. of pump pressure, the sharp leading edges of the top or upper surfaces of the profile screen wires start to wear down. This makes the screen much less effective since the screen wires become less able to cut or direct the starch solution through the screen opening. At this point, the top half of the screen is worn out. In the past, the screen has either then been discarded or has been rotated so that the previous trailing portion becomes the leading portion. This rotation of the screen has, in the past, not been an effective solution since the tilt of the now leading portion profile wire is incorrect and the efficiency of the screen is greatly reduced. Even though the lower half of the screen, prior to rotation of the screen, had not been worn since it acted only as a conveying surface for the previously separated out corn starch slurry, the rotation of the prior art screens has not been an effective way of extending the life of the screen.

It will be seen that a need exists for a sieve screen that will overcome the disadvantages of the prior art. The two way sieve screen in accordance with the present invention provides such a screen and is a significant advantage over the prior art.

SUMMARY OF THE INVENTION

It is an object of the present invention to provide a separatory or sieve screen.

Another object of the present invention is to provide a sieve screen having tilted profile wires.

A further object of the present invention is to provide a profile wire two way sieve screen having the tilt of the screen wires symmetrical about a transverse screen center line.

Yet another object of the present invention is to provide a pressure sieve screen having a symmetrical arrangement of profile screen wires.

Still a further object of the present invention is to provide a profile wire sieve screen that is reversible.

Even still another object of the present invention is to provide a two-way sieve screen for use in corn wet milling.

As will be discussed in detail in the description of the preferred embodiment, which is presented subsequently, the sieve screen in accordance with the present invention is a generally rectangular, arcuate or curved screen which is composed of a large number of profile screen wires. These profile screen wires are each generally triangular in cross-sectional shape and are arranged generally parallel to each other and generally normal to the direction of flow of the slurry which is to be separated. The profile screen wires are attached to underlying tie rods and are each tilted with respect to a radius of the arcuate screen. The tilt or angle of inclination of the individual profile wires is symmetrical, or a mirror image about a transverse center line of the sieve screen. In marked contrast with prior sieve screens, in which all of the profile wires have the same or similar angles of tilt over the entire length of the screen, in the two way sieve screen of the present invention, the wires on either side of the transverse center line are tilted in opposite directions.

The sieve screen of the present invention is of particular effectiveness in pressure separation apparatus where the slurry or flowable product to be separated is directed, under pressure into contact with the screen surface at an upper or inflow end portion. As the slurry flows down along the length of the sieve screen, the individual profile screen wires will cause fluid and solid separation in the generally well-known manner. After a period of usage, the elevated leading edges of the upper surfaces of the screen wires at the upper or inflow end of the screen will become worn and the effectiveness of the screen will decrease. As the efficiency of the screen falls below an acceptable level, the screen assembly in accordance with the present invention can be removed from its supporting enclosure, and can be reinstalled, after having been rotated through 180° about its transverse center line and also about a vertical center line. Such a rotation will bring the previous trailing portion of the sieve screen into a now upper inflow position to act as the separatory portion of the sieve screen.

In the pressure separation of liquid and solid components of a slurry, such as occurs in corn wet milling or in paper mills, it is only the upper half of the arcuate sieve screen which experiences the wear. The lower half of the screen acts only as a conveying surface. By structuring the screen in accordance with the present invention with the tilted profile screen wires symmetrical about a transverse center line, it is possible to effectively double the life of the screen. That portion of the screen which had previously acted essentially as a conveying surface can now be placed in an operational position so that those previously essentially unused profile screen wires will now be the ones which initially receive the slurry to be separated.

The two way sieve screen in accordance with the present invention is usable with a number of profile wire shapes, over a wide range of angles of tilt of the screen wires, over a wide range of slot opening widths, and in a diverse range of separatory environments. The orientation of the tilted screen wires symmetrically about the transverse center line of the arcuate screen effectively allows each screen to have twice the length of life, with virtually no additional manufacturing cost, when compared with prior products.

The sieve screen in accordance with the present invention overcomes the limitations of the prior art. It is a substantial advance in the art.

BRIEF DESCRIPTION OF THE DRAWINGS

While the novel features of the sieve screen in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
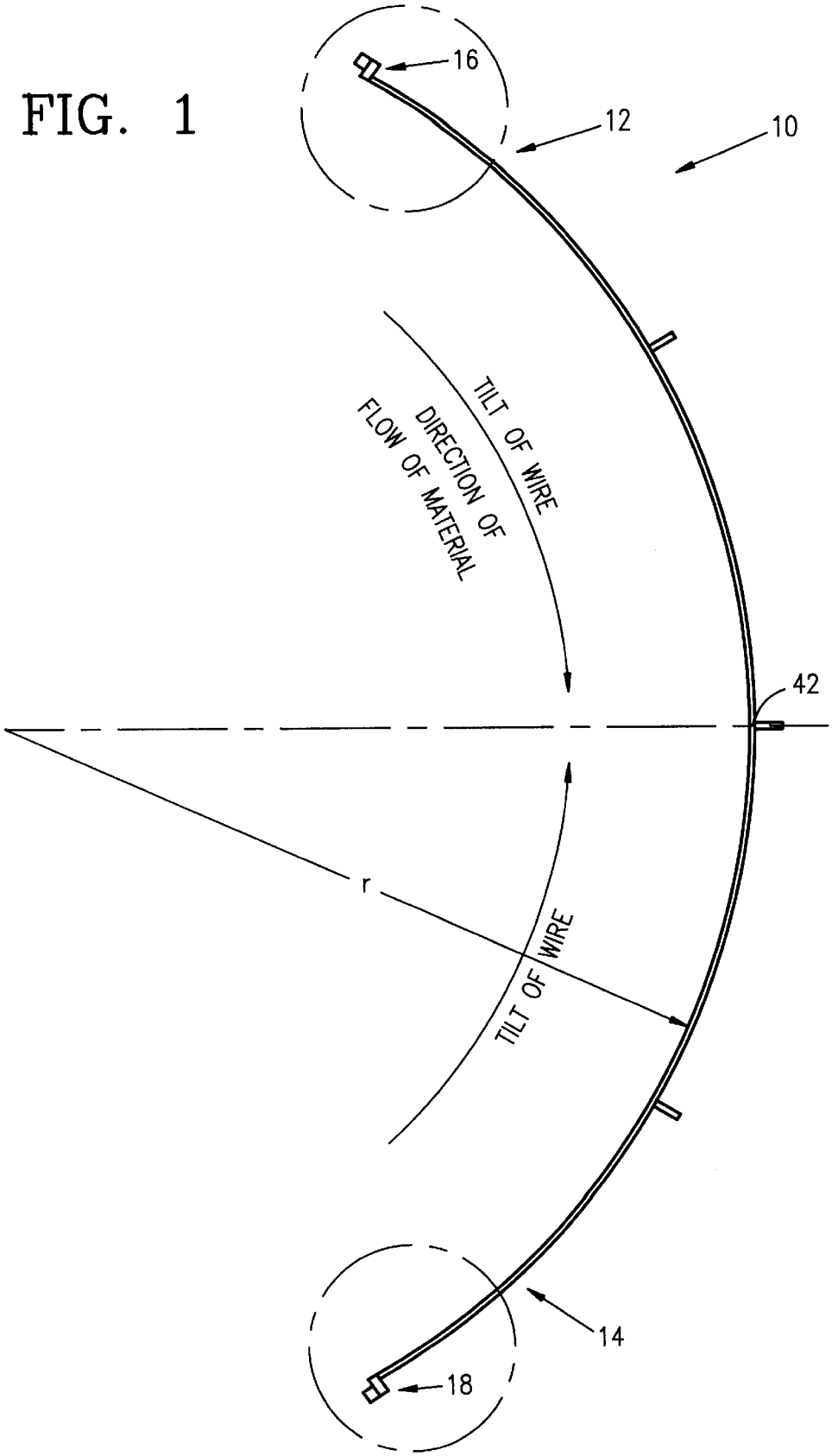
FIG. 1 is a schematic side elevation view of a two-way sieve screen in accordance with the present invention.
Figure 4:
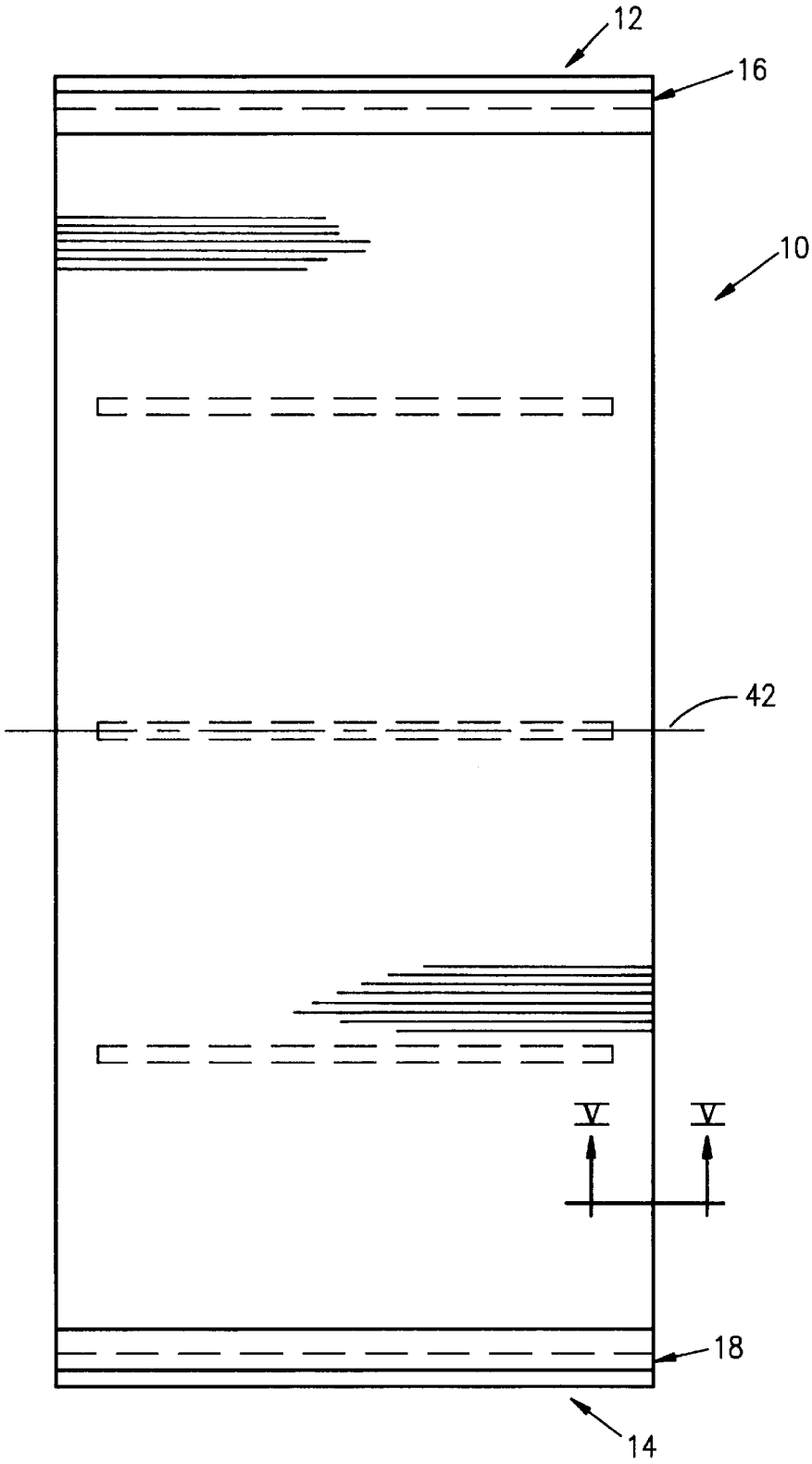
FIG. 4 is a front elevation view of the two-way sieve screen of the present invention.
Figure 7:
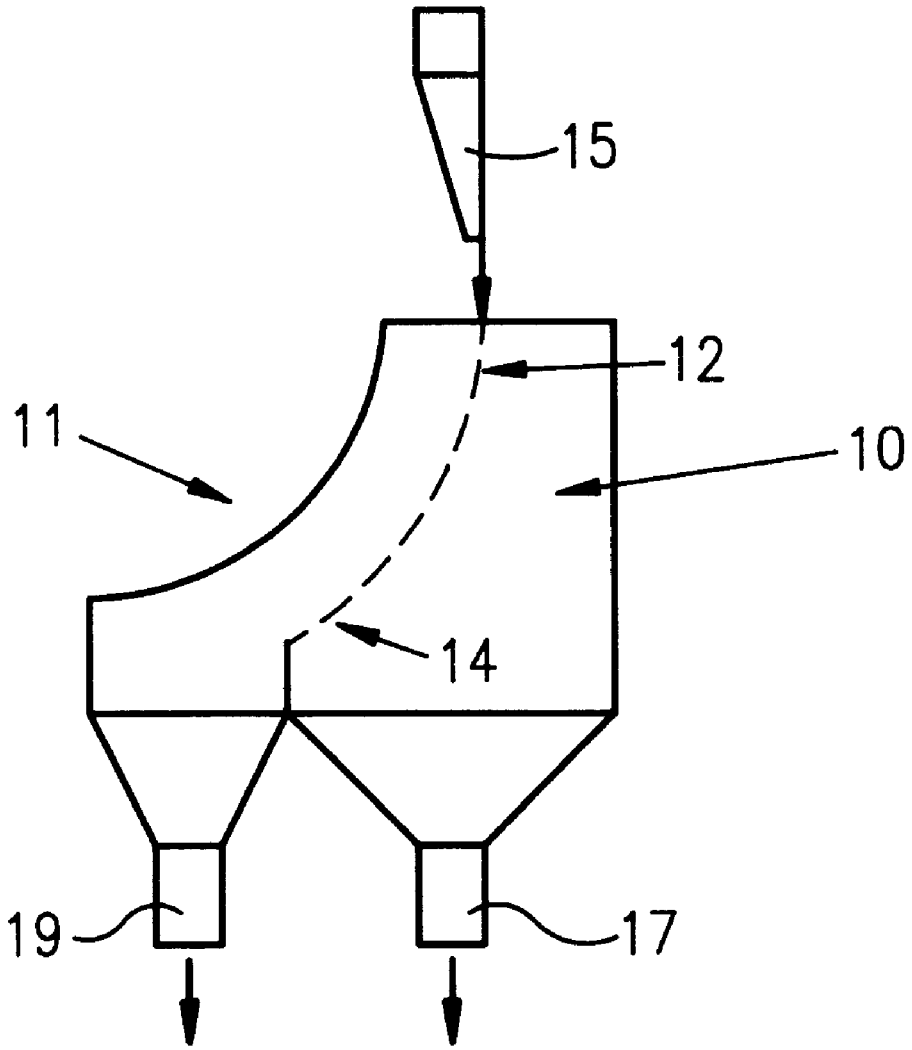
FIG. 7 is a schematic side elevation view of the screen of the present invention situated in a housing.

Referring initially primarily to FIGS. 1 and 4, there may be seen, generally at 10, a separatory or sieve screen in accordance with the present invention. Sieve screen 10 is intended for use in the separation of liquid and solid components in a flowable slurry or suspension. In one typical application, the sieve screen 10 is used to separate a solution of corn starch from ground or milled corn that has been mixed with water. In such a usage, the sieve screen 10 is oriented in a housing 11 generally as depicted in FIG. 7; i.e. in a generally vertical orientation with an upper or first end 12 of sieve screen 10 elevated and generally vertically above a lower or second end 14 of screen 10. The slurry or suspension of materials to be separated is introduced to the sieve screen 10 generally in the upper end 12 thereof from a head box 15 and flows down the surface of the sieve screen by gravity, as indicated by the direction of flow of material arrow shown in FIG. 1. Separatory sieve screens of this general nature are known in the art. One such exemplary prior art screen may be seen in U.S. Pat. No. 4,422,937. As is appreciated by one of skill in this art, these screens are typically situated in the housing 11 so that the liquids and suspended solids below a size defined by the spacing between the plurality of the profile screen wires, as will be discussed in detail shortly, pass through the separatory screens to a liquid and suspended solids outlet 17, and the oversize particles follow a path along the surface of the screen to an oversize particle outlet 19, as shown in FIG. 7.

Figure 2:
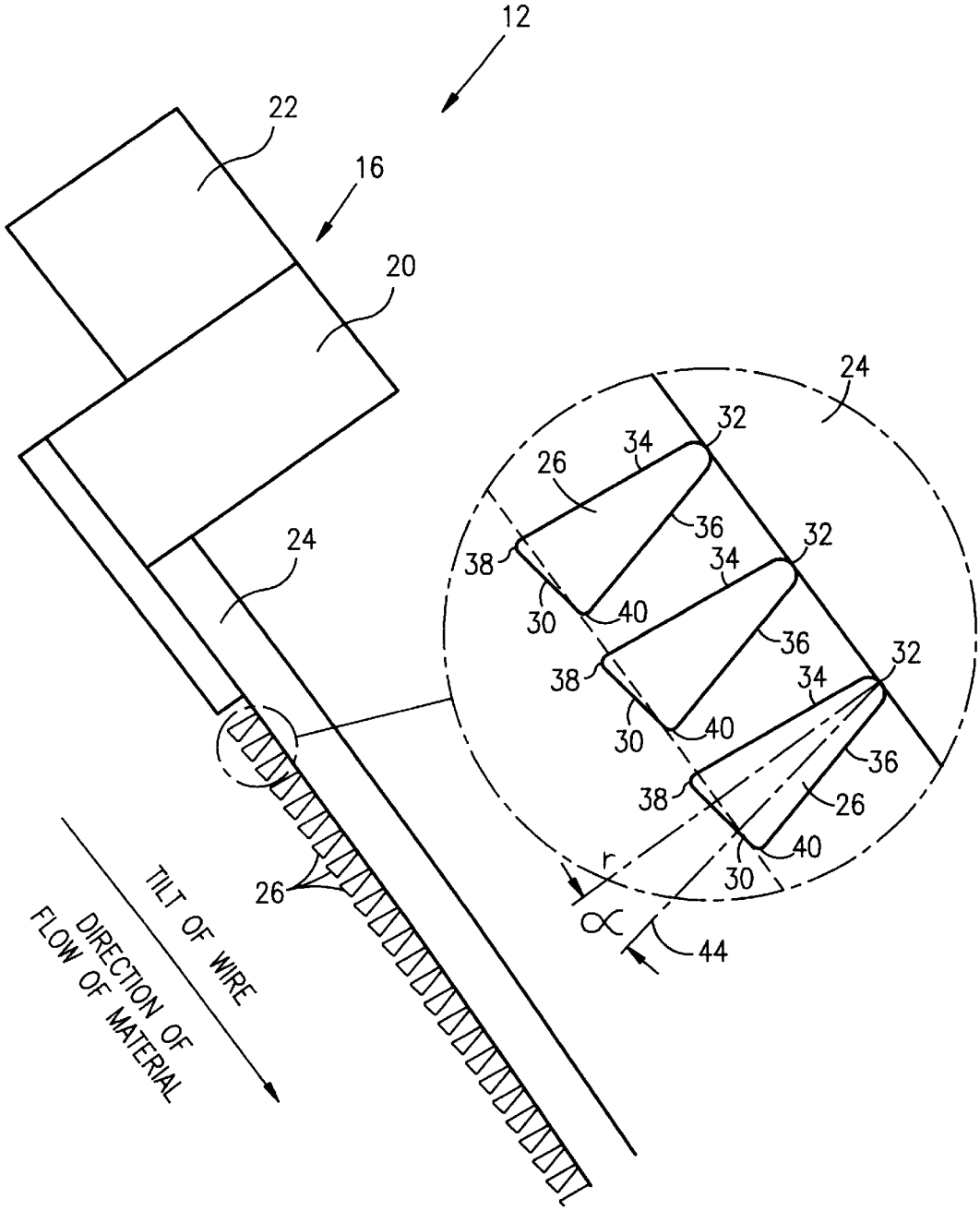
FIG. 2 is an enlarged view of the upper encircled portion of the sieve screen of FIG. 1.
Figure 3:
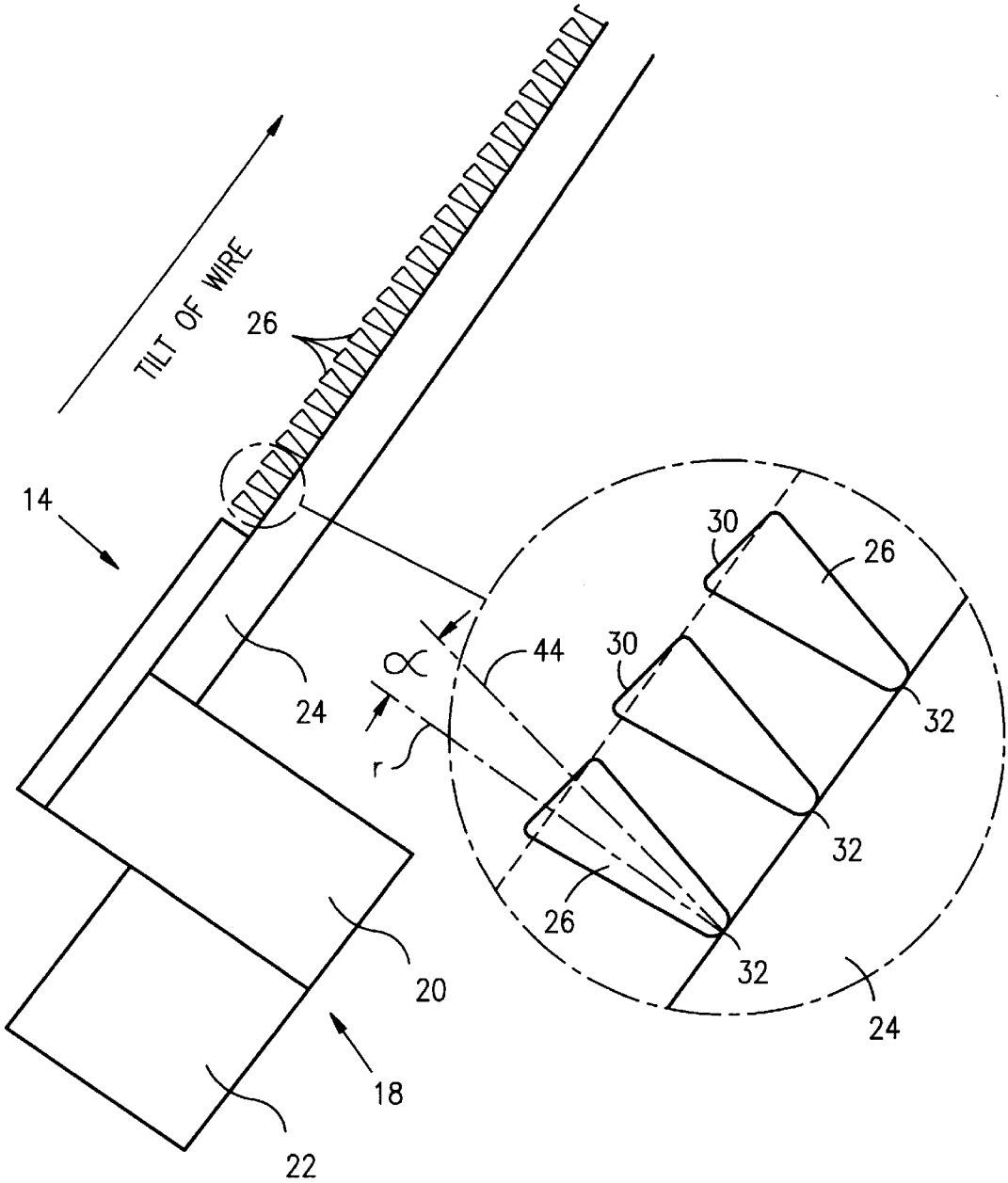
FIG. 3 is an enlarged view of the lower encircled portion of the sieve screen of FIG. 1.
Figure 5:
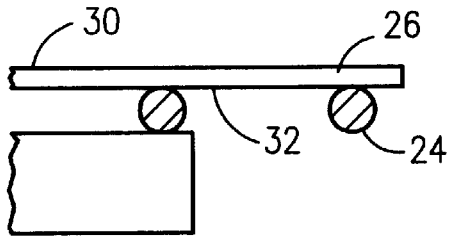
FIG. 5 is a cross-sectional view of the portion of the sieve screen taken along line V—V of FIG. 4.

Again referring to FIGS. 1 and 4, and also as may be seen in FIGS. 2, 3 and 5, the sieve screen 10 is generally rectangular in plan view and is generally arcuate in side elevation view. In a preferred configuration, the screen has a radius r of generally 30 inches and an arc of 120°. Such a sieve is suitable for use in corn wet milling or in paper mills and receives the material to be separated at a pressure in the range of 20–65 pounds. The sieve screen has a width of approximately 23 inches and an arcuate length of generally 64 inches.

The sieve screen 10 is defined by upper and lower frame members 16 and 18 respectively, as seen in FIGS. 2 and 3. Each frame member 16 or 18 is generally L-shaped and includes a frame rail 20 and a screen attachment flange 22. The screen attachment flanges 22 are used to secure the sieve screen 10 in the generally well-known support or housing 11 and can be provided with suitable apertures, pins, bolts or other generally conventional securement members or devices which are not specifically shown in the drawings.

A number of elongated tie rods 24, as shown in FIGS. 2, 3 and 5, extend from the top or upper frame member 16 to the lower or bottom frame member 18. These tie rods 24 are spaced parallel to each other, and, as may be seen in FIG. 5, are typically round in cross-section. In the sieve screen 10 depicted in FIG. 1, each of these tie rods is ⅛ inch in diameter and has a length of 62¼ inches so that it will extend from the upper frame rail 20 to the lower to frame rail 22.

These tie rods 24, as well as the frame members 16 and 18 are all made of 316 or similar stainless steel and are joined together by suitable welding. The upper and lower frame members 16 and 18, together with the tie rods 24 form the framework of the sieve screen 10. If desired, suitable side plates, which are not specifically shown in the drawings, but which are depicted in U.S. Pat. No. 4,422,937, the specification of which is specifically incorporated by reference herein, can be placed on the sides of the screen 10 to further define the flow path of the material fed to the screen 10.

Figure 6:
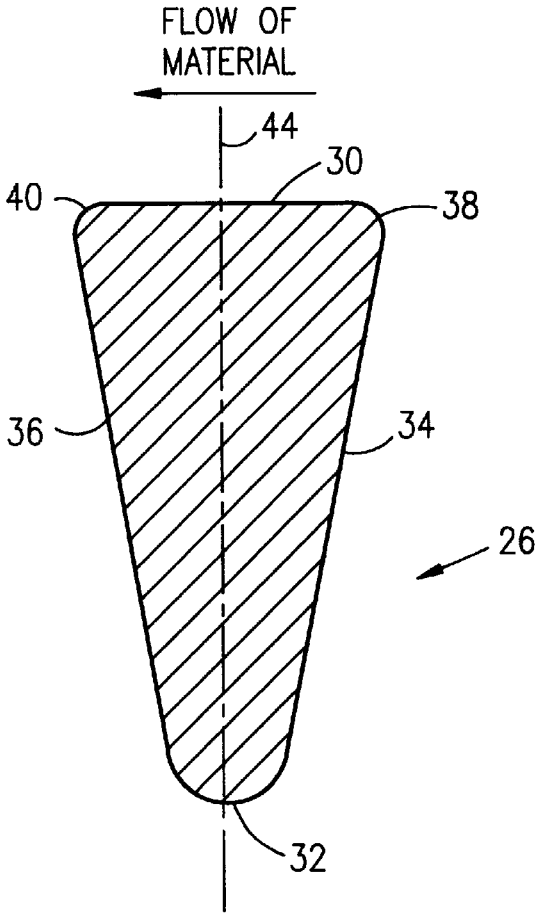
FIG. 6 is a cross-sectional view of a typical profile screen wire used in the sieve screen of the present invention.

A large number of profile screen wires 26 are secured to the underlying tie rods 24, as may be seen most clearly in FIGS. 2, 3 and 5. These screen wires 26 are arranged on the tie rods 24 generally parallel to each other and transverse to the tie rods 24. As such, the profile screen wires 26 are arranged generally normal to the direction of flow of the material passing down along the screen from the screen's upper end 12 towards its lower end 14 as indicated by the direction of flow arrow in FIG. 1, and as shown in FIG. 7. The cross-sectional shape of a typical profile screen wire 26 is shown in FIG. 6. Each such profile screen wire is made of 316 or equivalent stainless steel and is generally in the shape of an isosceles triangle. The base 30 of each of the triangular screen wires faces outwardly in the sieve screen since it is the apex 32 of the triangular profile screen wire 26 which is attached to the tie rods 24 by welding, as seen in the encircled portions of FIGS. 2 and 3, and in FIG. 5. In the preferred embodiment of a sieve screen in accordance with the present invention, the base width of each screen wire may be 0.020 inches, and the height of each profile screen wire may be 0.060 inch. The angles between the base 30 and the leading and trailing sides 34 and 36, respectively of the triangular screen wire 26 as taken in the flow direction A may be each 80°. The intersection of the leading side 34 and the base 30 of the profile wire 24 defines a leading edge 38 whereas the intersection of the trailing side 36 and the base 30 defines a trailing edge 40, all as seen in the encircled portions of FIGS. 2 and 3, and in FIG. 6. It will be understood that the preceding description of the specific shapes of the profile screen wire is intended to be exemplary and that screen wires having various profiles can be used in the present invention as can various overall sizes of screens, tie rods and the like.

In accordance with the present invention, the sieve screen generally at 10, is structured with the individual profile screen wires 26 each welded to the plural parallel tie rods 24 in a tilted orientation. The sieve screen is symmetrical about a transverse center line 42 which may be seen most clearly in FIG. 4. This transverse center line 42 of the sieve screen 10 is thus parallel to the longitudinal direction of the plurality of profile screen wires 26 and is normal to the material flow direction. In a first preferred arrangement of the sieve screen, as depicted in FIGS. 1, 2 and 3, each of the profile screen wires above the transverse center line 42 tilts in the direction indicated by the upper tilt arrow in FIG. 1; i.e. toward the transverse center 42 of the sieve screen 10. As seen in FIG. 1, this tilt or inclination of each of the screen wires 26 thus orients each of the screen wires with the leading edge 38 higher than its trailing edge 40, as measured from the supporting tie rods 24. In a similar fashion, and since the sieve screen is symmetrical about its transverse center line 42, the profile screen wires 26 below the center line 42 also tilt in the direction of the transverse center 42 of the screen 10, as indicated by the lower tilt arrow. Taken with respect to the direction of flow, the profile screen wires 26 above the transverse center line 42 tilt with the flow direction. The profile screen wires 26 below the transverse center line 42 tilt into or against the flow direction A. The angle of tilt, which is the angle of divergence $\alpha$ of a centerline 44 drawn from the apex 32 of each triangular screen wire through and perpendicular to the base 30 with respect to a radius line r of the arcuately shaped screen 10 may be constant over both the upper and lower ends of the profile screen 10. In other words, all of the profile screen wires 26 above the transverse central line 42, and all of the profile screen wires 26 below the transverse central line 42 may have the same angle of tilt $\alpha$. Since the sieve screen is symmetrical about the transverse central line 42, the profile screen wires above line 42 could be considered as having an angle $\alpha$ of declination whereas the profile screen wires below line 42 could be considered as having an angle $\alpha$ of inclination. This angle $\alpha$ of declination or inclination of the profile screen wires 26 can be in the range of 1° to 15° with an angle of 1°–4° being preferred for use in corn wet milling, depending or percent solids, pressure, and volumetric flow rate. The angle $\alpha$ will also vary depending on factors such as infeed pressure, rate, the spacing between the screen wires and other factors.

In an alternate configuration, the angle $\alpha$ of inclination or declination can vary with distance of the profile screen wires from the transverse central line 42. The angle $\alpha$ can either increase or decrease as a function of distance from the transverse center 42 of the sieve screen. So long as the screen 10 is symmetrical about this transverse center line 42, the angle of inclination or declination of each of the profile screen wires 26 can vary in accordance with the particular application to which the sieve screen will be placed.

In use, the sieve screen in accordance with the present invention is structured as discussed above, and is placed in the suitable support or housing 11, such as the one shown in FIG. 7 and described in U.S. Pat. No. 4,422,937. If the sieve screen is to be used in corn wet milling, the screen may be constructed with the profile screen wires 26 spaced from each other so as to define openings of 50 microns or 0.002 inches between respective leading and trailing edges 38 and 40 of adjacent bases 30 of the individual profile screen wires 26. Once so installed in a suitable housing, such as housing 11, the sieve screen will operate to separate a liquid constituent from a solids constituent. The liquid will pass through the openings between the adjacent profile screen wires 26 and out through outlet 17 while the solids will slide down along the base surfaces 30 of the profile screen wires and out through outlet 19. Over a period of time of operation, which time will depend on the hardness and abrasiveness of the material being separated, the elevated leading edges 38 of the individual profile screen wires 26 will wear down. Such wear reduces the efficiency of the screen to the point that it must be replaced. In the past, this was accomplished by discarding the screen and by installing a new screen. However, in accordance with the present invention, the screen 10 is removed, is rotated through 180° about the transverse central line 42 and also about a central vertical axis, and is reinstalled. Since the sieve screen 10 is symmetrical about the transverse central line 42, the prior lower or second end 14 of the screen is now the upper portion and the prior upper or first portion 12, which has experienced substantial wear, is now the lower portion. The newly oriented upper portion of the sieve screen 10 experienced little or no wear while it was situated beneath the transverse central line 42. It acted essentially as a support or conveying surface for the solids constituent of the slurry from which the bulk of the liquid had been removed in the upper sieve screen section 12. Since the initially lower portion 14 experienced very little, if any wear, and since the screen 10 is symmetrical about the transverse central line 42, the inversion and rotation of the sieve screen 10 in accordance with the present invention will effectively double the life of the screen. The re-oriented screen 10 places the unworn former lower screen section 14 into operating position while shifting the now worn former upper screen section 12 into a lower position where the wear sustained by the profile screen wires 26 is of little consequence.

Figure 8:
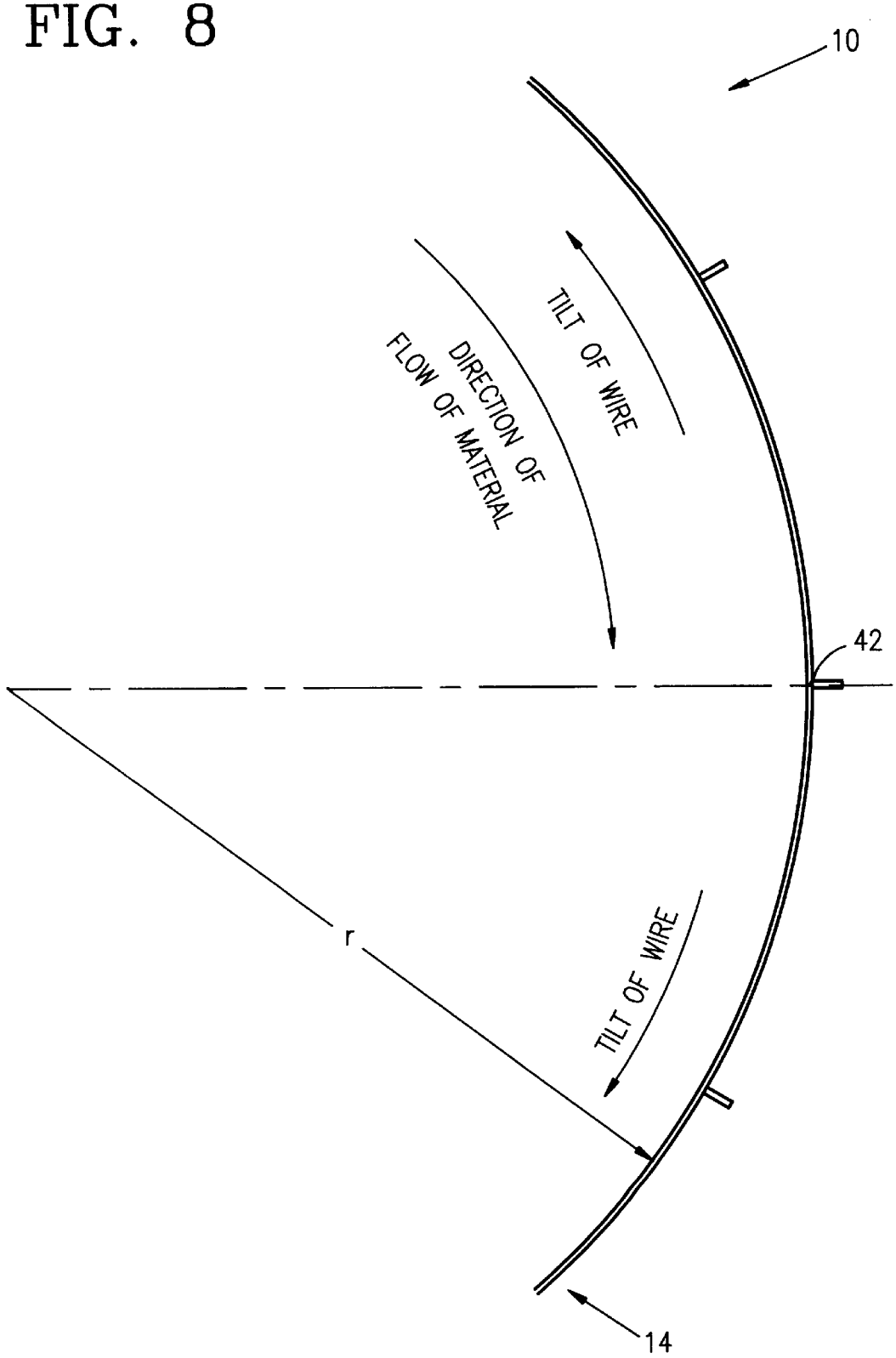
FIG. 8 is another schematic side elevation view of the separatory screen of the present invention.

In the sieve screen depicted in FIGS. 1, 2 and 3, and as discussed above, the individual profile screen wires 26 above the transverse central line 42 are depicted as declined with the direction of flow and have a uniform angle of declination $\alpha$. Similarly, the profile screen wires below the central line 42 are inclined against or into the direction of flow at a uniform angle of, in this case, inclination $\alpha$. It is also possible to arrange the screen wires 26 above the central line 42 inclined into or against the direction of flow. In such an orientation, the leading edge 38 of each screen wire 26 would be lower than the trailing edge 40 of each adjacent screen wire. Such an orientation may be desirable for various separatory operations. In such a screen 10, the profile screen wires 26 situated below the transverse central line 42 would be leaning with the direction of flow so that the screen 10 would continue to be symmetrical about the transverse central line 42, as depicted schematically in FIG. 8.

In accordance with the present invention, as discussed previously, it would be possible to vary the spacing between adjacent profile screen wires 26. Such a variance in spacings may be desirable for particular types of separation. Again such variation in profile wire separation would still be symmetrical about the transverse central line 42 so that the screen 10 could be inverted and rotated, as discussed above, when the initially upper end 12 of the screen 10 has become worn to the point that its efficiency had fallen below an acceptable level.

While a preferred embodiment of a sieve screen in accordance with the present invention has been set forth fully and completely hereinabove, it will be apparent to one of skill in the art that various changes such as the housing in which the screen is placed, the assembly used to hold the screen in the housing, the apparatus used to supply material to be separated to, and removed from the screen and the like may be made without departing from the true scope and spirit of the present invention which is accordingly to be limited only by the following claims.

What is claimed is:

1. A separatory screen useable to separate a flowable material, said separatory screen comprising:

a plurality of tie rods, said plurality of tie rods extending in a direction of flow of the flowable material flowing on said separatory screen;

means supporting said plurality of tie rods and forming a support frame, said support frame having a center line transverse to said direction of flow of the flowable material; and a plurality of profile screen wires on said plurality of tie rods, each of said profile screen wires being situated on said plurality of tie rods normal to said direction of flow, each of said profile screen wires having an upper surface, said plurality of profile screen wires being arranged on said tie rods with said upper surfaces inclined with respect to said direction of flow and symmetrical about said transverse center line.

2. The separatory screen of claim 1 wherein each of said profile screen wires is generally triangular in cross section.

3. The separatory screen of claim 1 wherein all of said profile screen wires before, in said direction of flow of material, said transverse center line are inclined against said direction of flow.

4. The separatory screen of claim 1 wherein said sieve screen is arcuate in side elevation and further wherein material to be separated is received on said sieve screen at an upper portion of said sieve screen.

5. The separatory screen of claim 1 wherein each of said plurality of profile screen wires is inclined at an angle of between 1° and 15°.

6. The separatory screen of claim 1 wherein all of said profile screen wires before, in said direction of flow of material, said transverse center line are inclined in said direction of flow.

7. The separatory screen of claim 6 further wherein all of said profile screen wires after, in said direction of flow of material, said transverse center line are inclined against said direction of flow.

8. The separatory screen of claim 6 further wherein all of said profile screen wires after, in said direction of flow of material, said transverse center line are inclined in said direction of flow.

* * * * *